US010212765B2

(12) United States Patent
Kamiya et al.

(10) Patent No.: US 10,212,765 B2
(45) Date of Patent: Feb. 19, 2019

(54) HEAT COOKING DEVICE

(71) Applicant: Panasonic Intellectual Property Management Co., Ltd., Osaka (JP)

(72) Inventors: Toshifumi Kamiya, Shiga (JP); Takahiro Hayashi, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/569,581

(22) PCT Filed: Aug. 23, 2016

(86) PCT No.: PCT/JP2016/003816
§ 371 (c)(1),
(2) Date: Oct. 26, 2017

(87) PCT Pub. No.: WO2017/033457
PCT Pub. Date: Mar. 2, 2017

(65) Prior Publication Data

US 2018/0098389 A1 Apr. 5, 2018

(30) Foreign Application Priority Data

Aug. 26, 2015 (JP) ..... 2015-166742

(51) Int. Cl.
*H05B 6/64* (2006.01)
*H05B 6/68* (2006.01)
(Continued)

(52) U.S. Cl.
CPC ..... *H05B 6/6441* (2013.01); *F24C 7/085* (2013.01); *H05B 6/6435* (2013.01); *F24C 15/006* (2013.01)

(58) Field of Classification Search
CPC ..... F24C 7/085; F24C 15/006; H05B 6/6441; H05B 6/6435
(Continued)

(56) References Cited

U.S. PATENT DOCUMENTS 4,345,132 A * 8/1982 Takase ..... G05B 19/102 219/492
4,375,586 A * 3/1983 Ueda ..... F24C 7/08 219/702
4,841,125 A * 6/1989 Edamura ..... H05B 6/6438 219/492

FOREIGN PATENT DOCUMENTS

JP 2004-212014 7/2004
JP 2008-121988 A 5/2008

OTHER PUBLICATIONS

International Search Report of PCT application No. PCT/JP2016/003816 dated Nov. 22, 2016.
(Continued)

*Primary Examiner* — Quang T Van
(74) *Attorney, Agent, or Firm* — Brinks Gilson & Lione

(57) ABSTRACT

In a heat cooking device equipped with a memory card attaching mechanism for inserting a memory card, the memory card attaching mechanism is configured to have, on a lower face of a main body of the heat cooking device, a card insertion port for inserting the memory card vertically upward. The card insertion port is configured to be hidden by a front grille panel attached to a machine chamber lying under the main body so as not to be exposed from the heat cooking device. Therefore, the reliable commercial heat cooking device that does not require a special waterproof measure can be provided.

5 Claims, 8 Drawing Sheets

(51) Int. Cl.
*F24C 7/08* (2006.01)
*F24C 15/00* (2006.01)

(58) Field of Classification Search
USPC ..... 219/714, 707, 492, 508, 702, 720, 506; 426/243, 523; 700/90; 902/22; 708/105, 708/133
See application file for complete search history.

(56) References Cited

OTHER PUBLICATIONS

Canadian Office Action dated Aug. 29, 2018 for the related Canadian Patent Application No. 2,987,557.

* cited by examiner

HEAT COOKING DEVICE

TECHNICAL FIELD

The present disclosure relates to heat cooking devices used to microwave-heat an object by radiating microwaves, and, in particular, relates to a commercial heat cooking device used as a cooking apparatus in commercial facilities including stores and restaurants such as convenience stores and fast-food restaurants.

BACKGROUND ART

In order to be able to respond to various menus, commercial heat cooking devices used in stores and restaurants such as convenience stores and fast-food restaurants are configured as described below. In addition to a microwave-heating mode with which an object is heat cooked by radiating microwaves, a grill mode with which the object is heat cooked through radiation heating using a heater, and a convection mode with which the object is heat cooked by using a fan to circulate air heated by the heater in a convection manner in a heating chamber. The commercial heat cooking devices used in stores and restaurants are required to securely execute each heating process for heat cooking at a precise temperature and a precise time. Therefore, the commercial heat cooking devices are configured such that a processing condition for each heating process is set beforehand, and the set processing condition is stored in a storage medium. Therefore, in each of stores and restaurants, by using a commercial heat cooking device provided with a storage medium, heat cooking can precisely be performed under an identical processing condition for an identical menu when ordered by a customer.

As described above, some commercial heat cooking devices are equipped with a storage medium storing heat cooking processing conditions so as to respond to various menus. In stores and restaurants, since a processing condition for each heating process should be changed each time a menu is changed, a replaceable memory card is used as the storage medium. Therefore, by changing a memory card, changing menus, for example, can easily be performed (e.g., see PTL 1).

In order to promptly respond to an order of a customer, a commercial heat cooking device is always turned on, and accordingly a cooling fan operates and a heating chamber is preheated. A waterproof measure should be taken because a commercial heat cooking device is often installed around a sink in a kitchen of a store or a restaurant, for example, and is sometimes spilled with water during cooking or cleaning, for example. In addition, an attaching mechanism to be inserted with a memory card served as a storage medium requires a configuration where no dust and dirt enter, as well as requires an insulation structure so as not to be subject to a high temperature. Therefore, a conventional commercial heat cooking device requires a special member and a larger space for providing an attaching mechanism for inserting a memory card. An exterior plate for covering a card insertion port for inserting a memory card is also required if the card insertion port is provided on a front face side of a commercial heat cooking device. In addition, when such an exterior plate for covering a card insertion port is provided, a label for indicating that the card insertion port is covered is required, as well as edges of the exterior plate should be smoothed such that a customer will not be suffered from an injury when the customer has touched the exterior plate. As a result, in such a conventional commercial heat cooking device, an increased work hour in component production, and thus a higher production cost have been problematic.

A commercial heat cooking device should be configured such that a user such as an employee of a store or a restaurant can replace a memory card, as well as a third party cannot easily access the memory card in order to prevent information from leaking, for example.

CITATION LIST

Patent Literature

PTL 1: Unexamined Japanese Patent Publication No. 2004-212014

SUMMARY OF THE INVENTION

The present disclosure has an object to achieve a commercial heat cooking device including a mechanism to be inserted with a memory card, which can neither easily be viewed externally, nor easily be accessed by a third party. Further, the mechanism to be inserted with the memory card has a configuration that does not allow dirt and dust to easily enter, that is not to be subject to a high temperature, and that does not require a special waterproof measure.

A heat cooking device according to an aspect of the present disclosure includes a main body having a heating chamber for accommodating and heating an object, a machine chamber provided under the main body and provided with a mechanism for forming and transmitting microwaves for microwave heating in the heating chamber, a front grille panel detachably provided on a front face of the machine chamber, a door openably configured with respect to the heating chamber, and a memory card attaching mechanism configured to insert a memory card into the main body. The memory card attaching mechanism is configured to have, on a lower face of the main body, a card insertion port for inserting the memory card vertically upward. The card insertion port is configured to be hidden by the front grille panel attached to the machine chamber so as not to be exposed from the heat cooking device.

The present disclosure can provide a reliable commercial heat cooking device including a memory card attaching mechanism, which can neither easily be viewed externally, nor easily be accessed by a third party, without requiring a special waterproof measure.

DESCRIPTION OF EMBODIMENT

Figure 1:
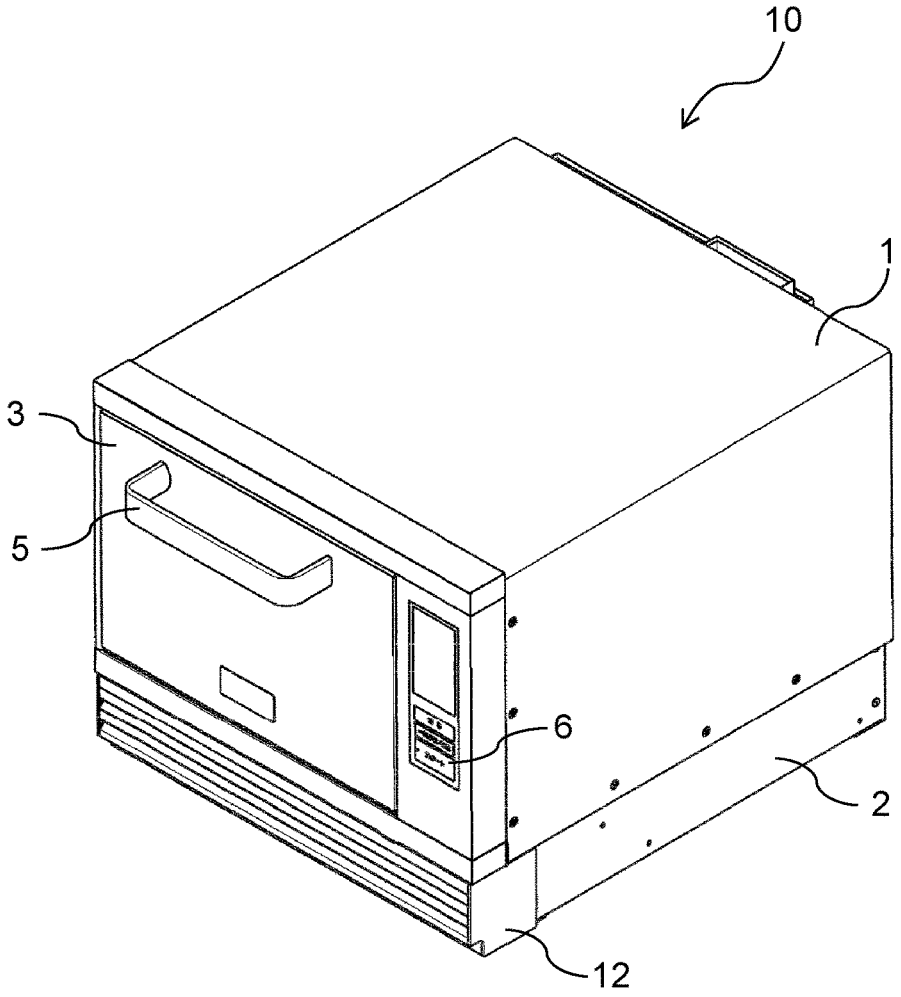
FIG. 1 is a perspective view of a heat cooking device according to an exemplary embodiment of the present disclosure when its door is closed.

A heat cooking device according to a first aspect of the present disclosure includes a main body having a heating chamber for accommodating and heating an object, a machine chamber provided under the main body and provided with a mechanism for forming and transmitting microwaves for microwave heating in the heating chamber, a front grille panel detachably provided on a front face of the machine chamber, a door openably configured with respect to the heating chamber, and a memory card attaching mechanism configured to insert a memory card into the main body. The memory card attaching mechanism is configured to have, on a lower face of the main body, a card insertion port for inserting the memory card vertically upward. The card insertion port is configured to be hidden by the front grille panel attached to the machine chamber so as not to be exposed from the heat cooking device.

As described above, the heat cooking device according to the first aspect of the present disclosure can provide a reliable commercial heat cooking device including a memory card attaching mechanism, which can neither easily be viewed externally, nor easily be accessed by a third party, without further requiring a special waterproof measure.

A heat cooking device according to a second aspect of the present disclosure is configured such that the card insertion port of the memory card attaching mechanism according to the first aspect is provided on a lower face of an operation unit provided on a front face of the main body so that a memory card inserted into the memory card attaching mechanism is accommodated in the operation unit.

As described above, the heat cooking device according to the second aspect of the present disclosure has a structure in which the operation unit itself is insulated from the heating chamber, and no heating component is present in the operation unit. In addition, inside of the operation unit is not included in a path into which a cooling fan blows air, for example, and thus foreign materials including dust and dirt would be less likely to enter. Therefore, in the configuration of the heat cooking device according to the second aspect of the present disclosure, no special insulation structure is required in the memory card attaching mechanism, and no special structure is required for preventing foreign materials including dust and dirt from entering. In addition, with the configuration of the heat cooking device according to the second aspect of the present disclosure, since a wiring path between the memory card attaching mechanism and an electric circuit board in the operation unit is shortened, the wiring path can be significantly less likely to be affected by noise.

In a heat cooking device according to a third aspect of the present disclosure, a card cover for covering the card insertion port according to the second aspect from beneath is rotatably provided.

As described above, the third aspect of the present disclosure can provide a reliable heat cooking device in which foreign materials including water and dust do not enter from the card insertion port of the memory card attaching mechanism.

In a heat cooking device according to a fourth aspect of the present disclosure, the operation unit according to the third aspect is internally configured such that a flat face of the memory card inserted into the memory card attaching mechanism is in parallel to a mounting face of the electric circuit board provided in the operation unit.

As described above, the heat cooking device according to the fourth aspect of the present disclosure is advantageous because the configuration in the operation unit can be simplified, as well as a required space in the operation unit can be reduced.

A heat cooking device according to a fifth aspect of the present disclosure is configured such that the cooling fan for cooling the mechanism in the machine chamber, according to the fourth aspect, blows outside air taken from the front grille panel via an outside air intake port formed on the front face of the machine chamber into the machine chamber. The memory card attaching mechanism is disposed away from a path into which the cooling fan blows the outside air.

As described above, the fifth aspect of the present disclosure can provide a reliable heat cooking device in which the memory card attaching mechanism is disposed away from the path into which outside air is blown, i.e., is not present in the path into which air is blown, and therefore, foreign materials including dust and dirt would be significantly less likely to enter.

Hereinafter, as a heat cooking device according to an exemplary embodiment of the present disclosure, a microwave oven served as a microwave heater capable of executing a microwave-heating mode, a grill mode, and a convection mode is used. In the exemplary embodiment described below, the heat cooking device that is a commercial microwave oven used in stores and restaurants, in particular, used in convenience stores and fast-food restaurants, will now be described herein with reference to the accompanied drawings. A configuration of the heat cooking device according to the present disclosure is not limited to a configuration of the commercial microwave oven described in the below exemplary embodiment, but includes a configuration of a heat cooking device based on a technical idea equivalent to a technical idea described in the below exemplary embodiment.

The commercial heat cooking device according to the exemplary embodiment of the present disclosure will now be described herein with reference to the accompanied drawings. Note however that some or all of the drawings are schematically rendered for illustration purpose, and components shown in the drawings do not always indicate their actual relative sizes and positions.

Figure 2:
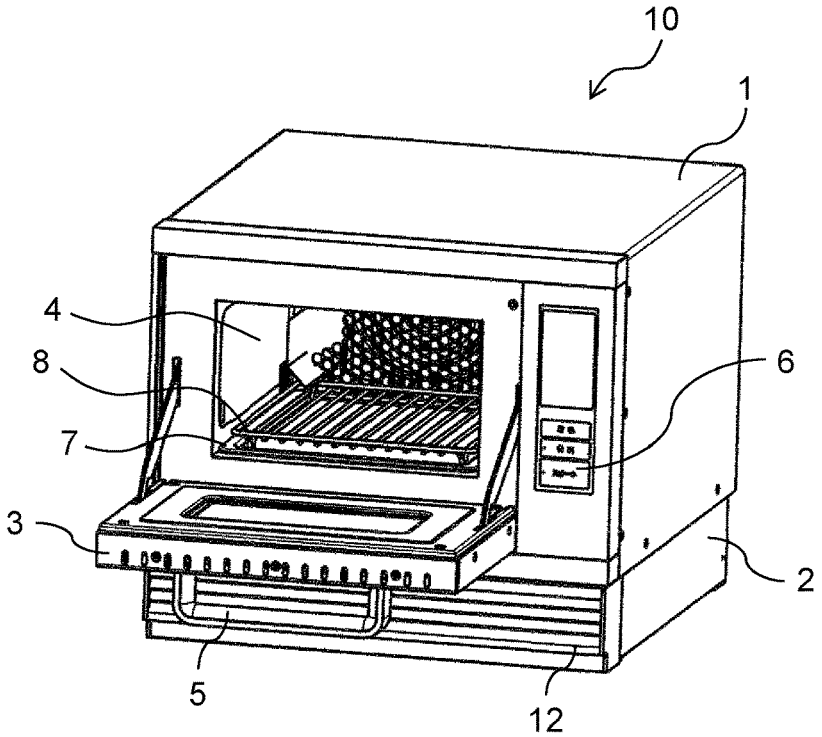
FIG. 2 is a perspective view of the heat cooking device according to the exemplary embodiment of the present disclosure when its door is open.

FIG. 1 is a perspective view illustrating an appearance of heat cooking device 10 according to the exemplary embodiment of the present disclosure when its door formed on a front face of heat cooking device 10 is closed. In FIG. 2, the door of heat cooking device 10 shown in FIG. 1 is open, and thus a heating chamber formed in heat cooking device 10 is open.

Heat cooking device 10 according to this exemplary embodiment is a commercial microwave oven used in stores and restaurants, in particular, used in convenience stores and fast-food restaurants, has a maximum output ranging from 1200 W to 1300 W, and is configured to be capable of switching an output in plural steps.

As shown in FIGS. 1 and 2, heat cooking device 10 includes main body 1 configuring an outer case of the heating chamber, machine chamber 2 provided under main body 1 so as to support main body 1, and door 3 attached on a front face side of main body 1. Detachable front grille panel 12 is provided on a front face side of machine chamber 2.

As shown in FIG. 2, heating chamber 4 is formed inside of main body 1. Heating chamber 4 is a space formed in an approximately rectangular parallelepiped shape having an opening on its front face side (door side) for internally accommodating an object. In the following description, the side of heating chamber 4, on which the opening is formed, is defined as a front side of heat cooking device 10, and a back side of heating chamber 4 is defined as a rear side of heat cooking device 10. A right side of heat cooking device 10 when heat cooking device 10 is viewed from front is simply referred to as a right side, and a left side of heat cooking device 10 when heat cooking device 10 is viewed from front is simply referred to as a left side.

Door 3 is vertically openably attached on the front face side of main body 1 so as to cover the opening on a front of heating chamber 4. Door 3 is configured in such a manner that a user holds handle 5 provided on door 3 to open or close door 3. When door 3 is closed as shown in FIG. 1, heating chamber 4 is internally formed in a closed space so that an accommodated object is heat processed with microwaves, for example. When door 3 is open as shown in FIG. 2, the user can put or remove the object into or from heating chamber 4.

In heat cooking device 10 according to this exemplary embodiment, operation unit 6 is provided on a right side of a front face of main body 1. Operation unit 6 is provided with operation buttons for setting a processing condition for heat cooking in heat cooking device 10, and a display screen.

As shown in FIG. 2, heating chamber 4 is internally disposed with tray 7 made of ceramics (specifically, made of cordierite), and wire rack 8 made of stainless steel in an accommodatable manner. Wire rack 8 is a loading portion formed from a mesh member for loading the object. Tray 7 is provided under wire rack 8 to catch fat components, for example, dropping from the object on wire rack 8.

In heat cooking device 10 according to this exemplary embodiment, machine chamber 2 under heating chamber 4 is provided with a magnetron served as a microwave generator. Microwaves generated from the magnetron radiate, via a wave guide, from microwave radiation holes formed on the wave guide and openings formed on a bottom face side of heating chamber 4. The microwaves radiated from the microwave radiation holes on the wave guide and the openings formed on the bottom face of heating chamber 4 into heating chamber 4 will be stirred by a stir (agitator). By the heat cooking device configured as described above, the object accommodated in heating chamber 4 can be microwave heated.

In heat cooking device 10 according to this exemplary embodiment, a grill heater formed based on a sheath heater is provided on a ceiling side of heating chamber 4 so that a grill mode is executed to directly heat the object in heating chamber 4 with radiant heat of the grill heater.

In addition, a convection device configured to supply hot air into heating chamber 4 is provided behind a back wall of heating chamber 4. The convection device has a function to take air in heating chamber 4, to heat the taken air, and to blow the hot air into heating chamber 4. As described above, the convection device supplies hot air into heating chamber 4, and the hot air causes a circulating flow to occur in heating chamber 4. For example, the convection device takes air from a central area of heating chamber 4, heats the taken air, and blows the hot air from a front side of the bottom face and/or a front side of a ceiling into heating chamber 4 to circulate the hot air.

As described above, heat cooking device 10 according to this exemplary embodiment is configured to be capable of separately or simultaneously performing heating with microwaves supplied from the magnetron served as a microwave generator, heating through radiation of heat using the grill heater provided on an upper side of heating chamber 4, and heating through a circulating flow of hot air using the convection device.

Heat cooking device 10 according to this exemplary embodiment is configured such that a heater that is a larger heat source does not lie under the object accommodated in the heating chamber. Therefore, a liquid such as a fat component dropping from the object does not come into contact with a heater, and thus a highly safe heat cooking device can be achieved, where neither smoke nor a fire occurs.

Machine chamber 2 is internally provided with components including the magnetron served as a microwave generator for generating microwaves, an inverter for driving the magnetron, and a cooling fan for cooling the magnetron, the inverter, and other components.

In this exemplary embodiment, two of the magnetrons are used, and a total output ranges from 1200 W to 1300 W inclusive. Microwaves output from the two magnetrons respectively transmit into two wave guides, and radiate into the heating chamber via microwave radiation openings respectively formed on the wave guides and openings formed on the bottom face of heating chamber 4. The microwaves are stirred by the stir, and then radiated into heating chamber 4.

The inverter drives each of the magnetrons. Two of the inverters for respectively driving the two magnetrons are provided in the machine chamber. In machine chamber 2, a plurality of the cooling fans is also disposed for respectively cooling the magnetrons and the inverters. In this exemplary embodiment, four of the cooling fans are provided. The cooling fans respectively take outside air from front grille panel 12 provided on a front face of machine chamber 2, and blow the taken outside air rearward to sequentially cool the inverters and the magnetrons arranged in a file.

Figure 3:
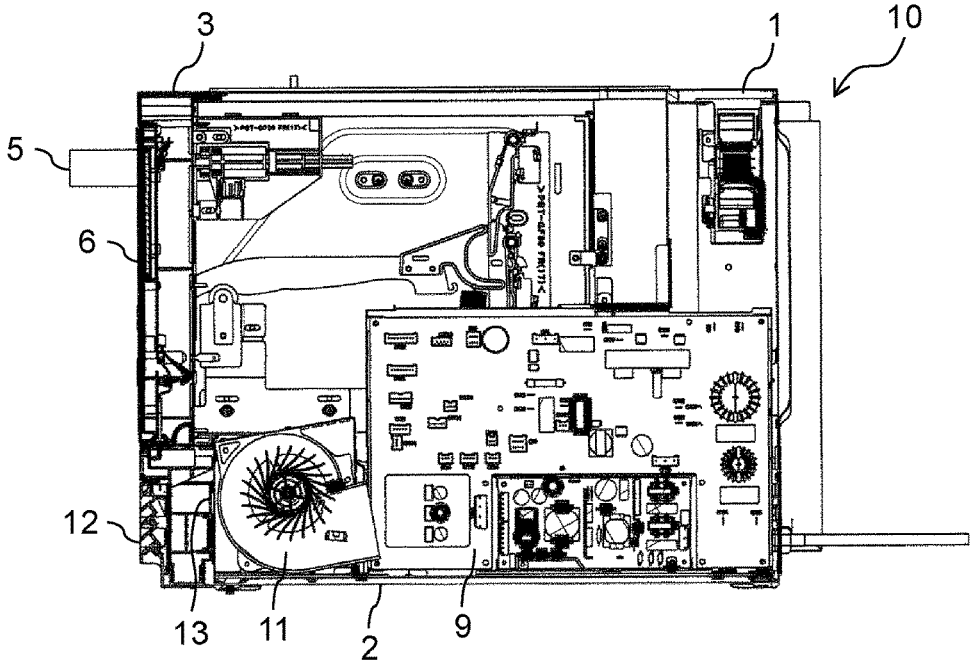
FIG. 3 is a cross-sectional view of the heat cooking device according to the exemplary embodiment of the present disclosure, when its right side face is removed.

A power supply circuit board is provided in machine chamber 2, and a cooling fan for cooling the power supply circuit board is provided. FIG. 3 is a cross-sectional view of heat cooking device 10 according to the exemplary embodiment, when its right side face is removed. As shown in FIG. 3, cooling fan 11 is disposed on the front face side of machine chamber 2. Upon cooling fan 11 starts, air is taken from front grille panel 12 provided on the front face of machine chamber 2 to cool power supply circuit board 9 disposed behind cooling fan 11. The magnetrons, the inverters, the wave guides, and other components provided in machine chamber 2 are hidden by power supply circuit board 9 and cooling fan 11 shown in FIG. 3.

In this exemplary embodiment, the four cooling fans arranged in parallel to cool heating portions of the inverters and the magnetrons and other components and cooling fan 11 for cooling the power supply circuit board are formed by multi-blade fans. The cooling fans are installed such that their rotation axes align in a straight line, and configured to take air in an axial direction of each of the rotation axes, and to blow the air toward a rear of machine chamber 2 in an outer peripheral direction. The air blown toward the rear of machine chamber 2 passes through an exhaust duct disposed on a rear face of main body 1 and a gap between a ceiling wall of heating chamber 4 and an upper face wall of main body 1, and exits from the front face side of main body 1. As described above, air flowing from the cooling fans prevents the upper face wall around a rear wall of main body 1 from being heated.

Memory Card Attaching Mechanism

In the commercial heat cooking device configured as described above, a memory card attaching mechanism is provided for inserting a smaller memory card such as an SD card storing various processing conditions for heat cooking.

Figure 4:
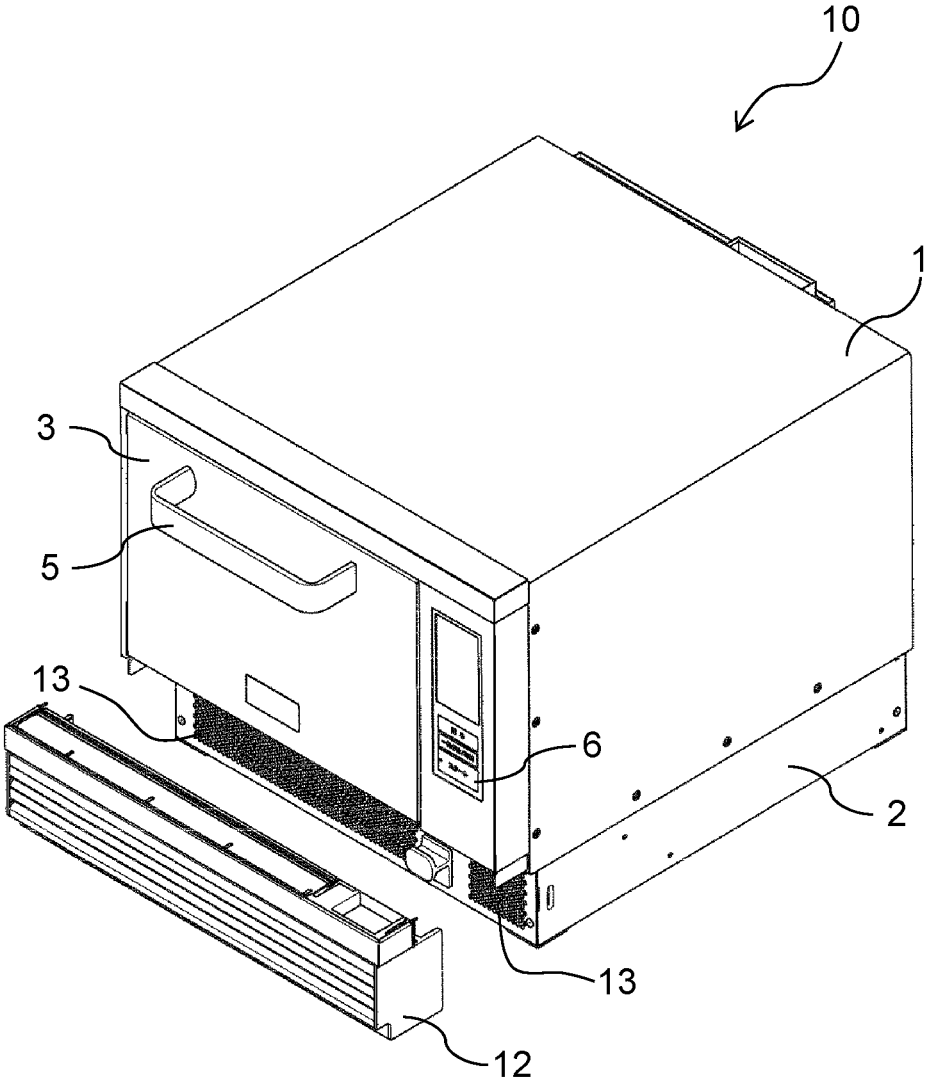
FIG. 4 is a perspective view of the heat cooking device according to the exemplary embodiment of the present disclosure, when viewed obliquely from upper right.
Figure 5:
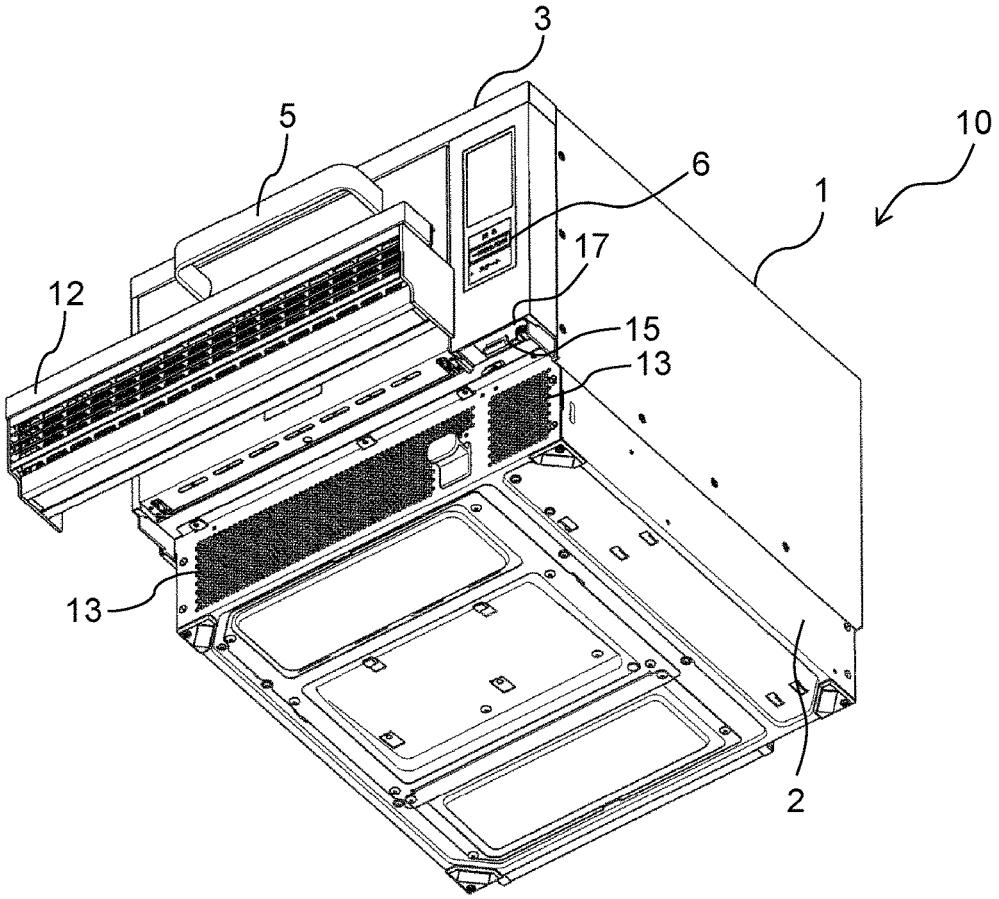
FIG. 5 is a perspective view of the heat cooking device according to the exemplary embodiment of the present disclosure, when viewed obliquely from lower right.

FIGS. 4 and 5 are perspective views of commercial heat cooking device 10 according to this exemplary embodiment, where front grille panel 12 provided on the front face side of machine chamber 2 is removed. FIG. 4 is a perspective view when viewed obliquely from upper right, and FIG. 5 is a perspective view when viewed obliquely from lower right. Front grille panel 12 configuring an exterior on a lower portion of a front face side of heat cooking device 10 is detachable with respect to machine chamber 2. On a front face of front grille panel 12, a plurality of plate materials is provided in parallel in a vertical direction so as to have a predetermined gap and to face obliquely downward to take outside air from beneath. On the front face of machine chamber 2, when front grille panel 12 is removed, outside air intake port 13 formed by a plurality of punching holes is provided. In machine chamber 2 according to this exemplary embodiment, the four cooling fans for cooling the inverters, the magnetrons, and other components, and cooling fan 11 for cooling the power supply circuit board are provided in parallel immediately behind outside air intake port 13.

Figure 6:
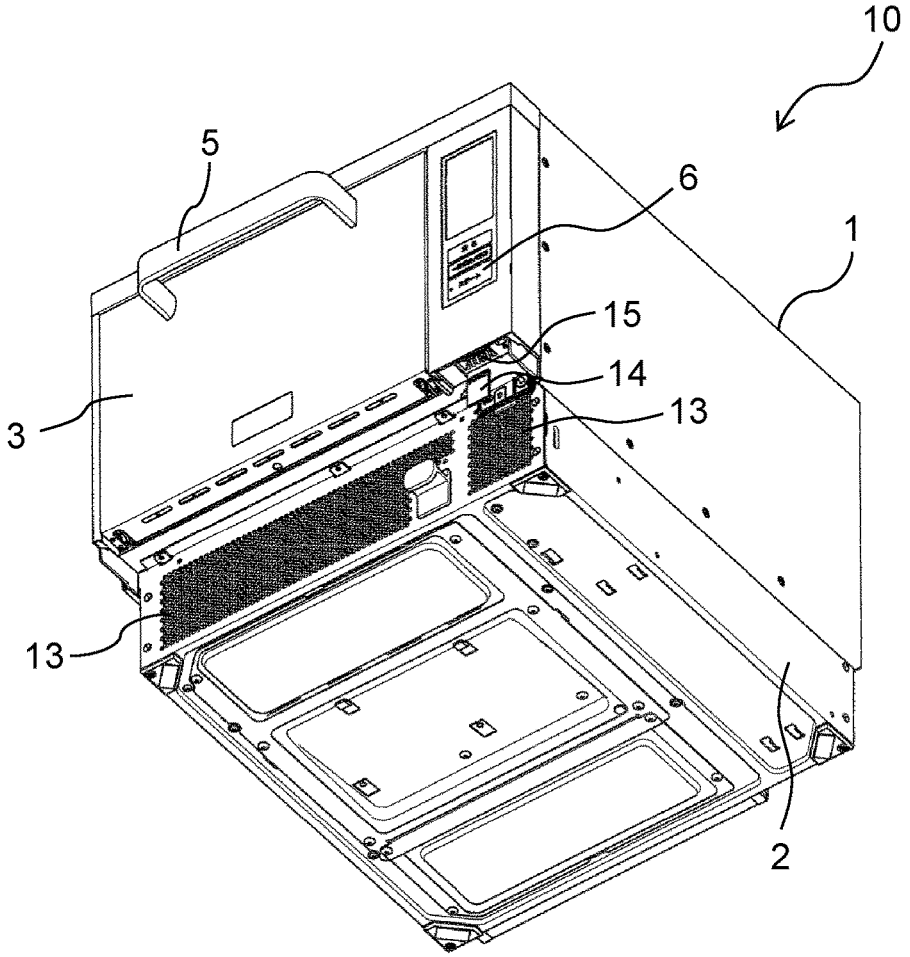
FIG. 6 is a perspective view of the heat cooking device according to the exemplary embodiment of the present disclosure, when a front grille panel is removed, and when viewed obliquely from below.

FIG. 6 is a view of heat cooking device 10 when front grille panel 12 is removed, and when viewed obliquely from below. As shown in FIG. 6, memory card attaching mechanism 15 is provided under operation unit 6 provided on a right side of the front face of main body 1. When front grille panel 12 is attached to the front face of machine chamber 2, front grille panel 12 is disposed immediately below operation unit 6 and door 3, and thus memory card attaching mechanism 15 is not exposed from the heat cooking device, and cannot be viewed. In this exemplary embodiment, memory card attaching mechanism 15 is inserted with a smaller memory card, i.e., SD card 14.

Figure 7:
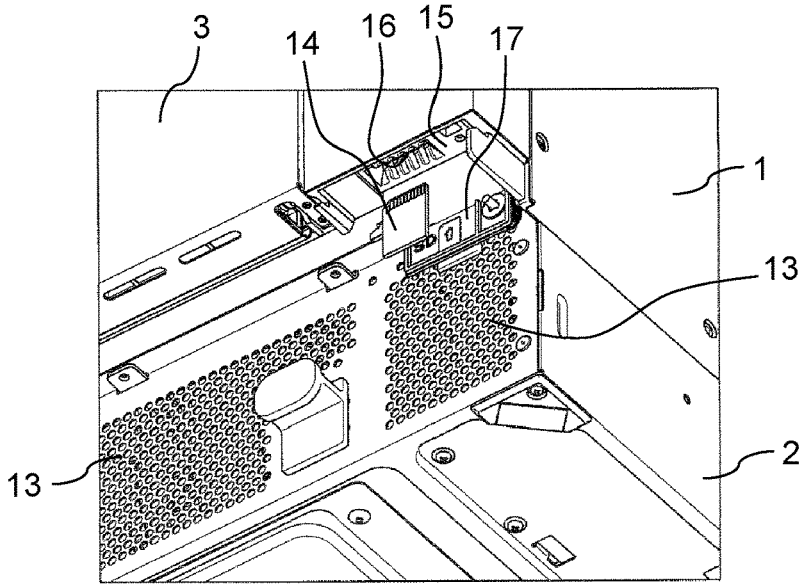
FIG. 7 is an enlarged view of a memory card attaching mechanism of the heat cooking device shown in FIG. 6.

FIG. 7 is an enlarged view of memory card attaching mechanism 15 shown in FIG. 6. In FIG. 7, SD card 14 is about to be inserted into card insertion port 16 of memory card attaching mechanism 15. As shown in FIG. 7, memory card attaching mechanism 15 is provided with card insertion port 16 for inserting SD card 14 upward, and card insertion port 16 is provided on a lower face of operation unit 6.

Figure 8:
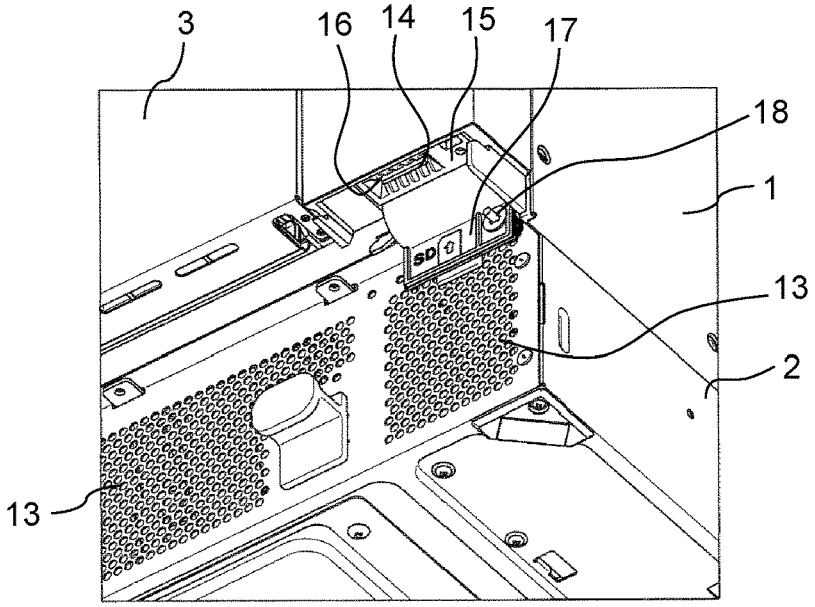
FIG. 8 is a view of the memory card attaching mechanism shown in FIG. 7, when a memory card is inserted.

FIG. 8 is a view when SD card 14 is inserted into card insertion port 16 of memory card attaching mechanism 15. As shown in FIG. 8, although SD card 14 is projecting somewhat from card insertion port 16, a recess formed around card insertion port 16 surrounds projecting SD card 14. Therefore, while SD card 14 is inserted into memory card attaching mechanism 15, SD card 14 does not substantially project from the lower face of operation unit 6.

In memory card attaching mechanism 15 according to this exemplary embodiment, card cover 17 attached so as to cover SD card 14 after SD card 14 is inserted is provided. Card cover 17 is fixed to memory card attaching mechanism 15 with an easily removable fastener such as screw 18 to cover and securely seal card insertion port 16 into which SD card 14 is inserted from beneath. Therefore, SD card 14 is configured so as to neither be easily accessed nor removed, as well as card insertion port 16 is configured so as to securely prevent foreign materials including dust and dirt from entering.

Figure 9:
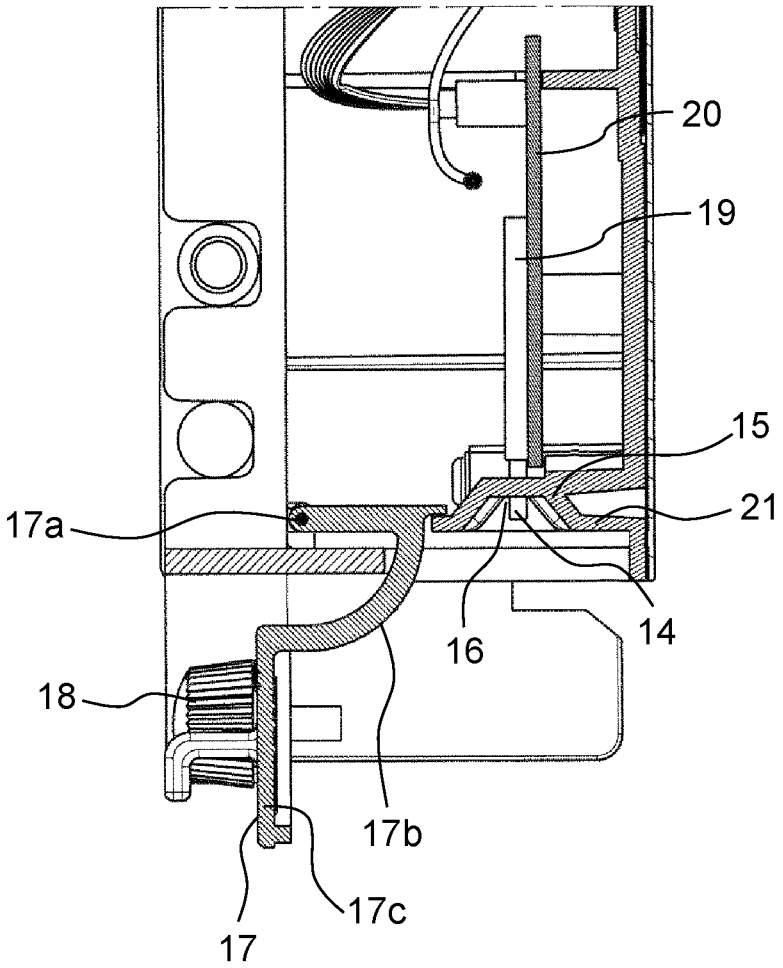
FIG. 9 is a side cross-sectional view of the memory card attaching mechanism of the heat cooking device according to the exemplary embodiment of the present disclosure.

FIG. 9 is a side cross-sectional view of memory card attaching mechanism 15 according to this exemplary embodiment, when SD card 14 inserted into memory card attaching mechanism 15 is viewed from left. FIG. 9 illustrates a state in which SD card 14 is inserted into memory card attaching mechanism 15, but card cover 17 is not attached yet. The side cross-sectional view shown in FIG. 10 illustrates a state, in which card cover 17 is attached to memory card attaching mechanism 15, shifted from the state shown in FIG. 9.

Figure 10:
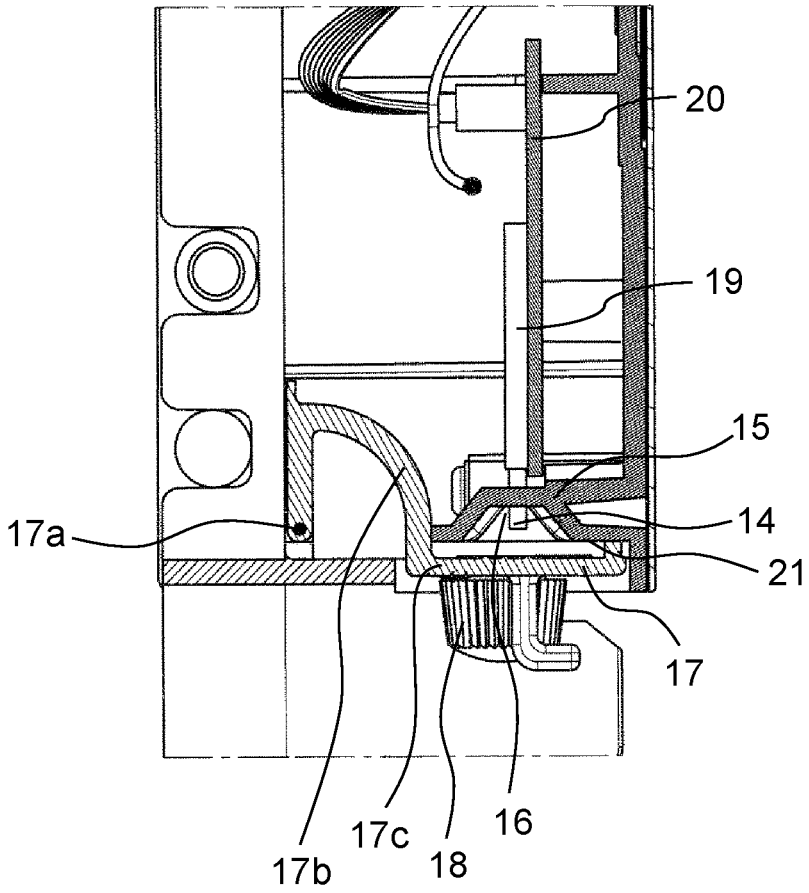
FIG. 10 is a side cross-sectional view of the memory card attaching mechanism of the heat cooking device according to the exemplary embodiment of the present disclosure.

As shown in FIGS. 9 and 10, card cover 17 according to this exemplary embodiment is configured to be rotatable about hinge 17*a*. Card cover 17 includes curved portion 17*b* formed to detour a part of the housing, which lies on a lower end (lower face) of operation unit 6, and fixing portion 17*c* covering and sealing card insertion port 16 from beneath. Fixing portion 17*c* of card cover 17 is provided with a fastener, i.e., screw 18, and fixing portion 17*c* is configured to securely cover card insertion port 16 of memory card attaching mechanism 15.

Memory card attaching mechanism 15 according to this exemplary embodiment includes lower face wall 21 of operation unit 6, on which card insertion port 16 is formed, SD card connector 19 that is electrically connected to a control circuit and that accepts SD card 14, and base 20 for holding SD card connector 19 in an inner space of operation unit 6. Card cover 17 is attached to lower face wall 21 of operation unit 6, on which card insertion port 16 is formed, to substantially configure the lower face of operation unit 6.

As shown in FIGS. 9 and 10, in memory card attaching mechanism 15, an attaching face of base 20, onto which SD card connector 19 is fixed, is a vertical face in the inner space of operation unit 6 such that an insertion direction of SD card connector 19 is vertically upward. SD card connector 19 is configured to be fixed to base 20 such that a flat face of SD card 14 being inserted is in parallel to the mounting face (flat face) of the electric circuit board (control circuit board) provided in operation unit 6. Therefore, in operation unit 6, SD card connector 19 can be provided using base 20, similar to other electric circuit boards, without providing a special member, and thus the inner space of operation unit 6 can effectively be used. In addition, the commercial heat cooking device according to this exemplary embodiment is configured to be capable of reducing a space for providing memory card attaching mechanism 15. The feature contributes to a reduction in whole device size.

Since the inner space of operation unit 6 is disposed via an insulation member to have a predetermined space with respect to heating chamber 4, and a member to be heated to a high temperature is not provided, SD card connector 19 will not be subject to a high temperature. Since a member that generates greater noise is not provided, as well as a wiring distance from SD card connector 19 to the control circuit is shorter, the inner space of operation unit 6 has a configuration in which an error would be less likely to occur in obtaining information from SD card 14 inserted into memory card attaching mechanism 15.

As described above, the heat cooking device according to this exemplary embodiment is configured such that the memory card attaching mechanism having card insertion port 16 into which a memory card is to be inserted is hidden by front grille panel 12 detachably attached on the front face side of machine chamber 2, and thus cannot be viewed externally from the heat cooking device. Therefore, when exchanging a memory card, front grille panel 12 and card cover 17 provided on the lower face side of operation unit 6 should be removed to access card insertion port 16.

Card insertion port 16 is provided on the lower face of operation unit 6, and is configured to be inserted with a memory card vertically upward to attach the memory card into the memory card attaching mechanism. Therefore, card insertion port 16 is surrounded by the recess on lower face wall 21 of operation unit 6, is disposed downward, and is structured to prevent water from entering. Thus, a structure with a water-proof feature is not required for card insertion port 16 and a memory card connector (SD card connector 19).

As described above, in the commercial heat cooking device according to this exemplary embodiment, since a card insertion port exposed from a front face side, which can often be seen in a conventional commercial heat cooking device, is not provided, neither an exterior plate for covering the card insertion port nor processing for such an exterior plate are not required, and a problem of an increased work hour in component production does not arise.

In the commercial heat cooking device according to this exemplary embodiment, the memory card attaching mechanism has an external configuration that can neither easily be viewed externally, nor easily be accessed by a third party. The commercial heat cooking device according to this exemplary embodiment is configured such that foreign materials including dust and dirt would be less likely to enter, and so as not to be subject to a high temperature. In addition, in the commercial heat cooking device according to this exemplary embodiment, a simple, reliable heat cooking device without requiring a special waterproof measure is provided.

The present disclosure has been described in the exemplary embodiment in detail to a certain level. However, the contents of disclosure in the exemplary embodiment can obviously change in detailed configurations, and changes in combination and order of components in the exemplary embodiment can be achieved without departing from the scope and spirit of the appended claims of the present disclosure.

INDUSTRIAL APPLICABILITY

The present disclosure has a configuration applicable to heat cooking devices for heating and cooking an object, and in particular to heat cooking devices such as commercial microwave ovens used in, for example, stores and restaurants, in particular, used in convenience stores and fast-food restaurants.

REFERENCE MARKS IN THE DRAWINGS

1 main body
2 machine chamber
3 door
4 heating chamber
5 handle
6 operation unit
7 tray
8 wire rack
9 power supply circuit board
10 heat cooking device
11 cooling fan
12 front grille panel
13 outside air intake port
14 SD card
15 memory card attaching mechanism
16 card insertion port
17 card cover
18 fastener (screw)
19 SD card connector
20 base

The invention claimed is:

1. A heat cooking device comprising:

a main body having a heating chamber for accommodating and heating an object;

a machine chamber provided under the main body, the machine chamber being equipped with a mechanism for forming and transmitting microwaves for microwave heating in the heating chamber;

a front grille panel detachably provided on a front face of the machine chamber;

a door configured to be openable with respect to the heating chamber; and a memory card attaching mechanism configured to insert a memory card into the main body, wherein the memory card attaching mechanism is configured to have, on a lower face of the main body, a card insertion port for inserting the memory card vertically upward, the card insertion port being configured to be hidden by the front grille panel attached to the machine chamber so as not to be exposed from the heat cooking device.

2. The heat cooking device according to claim 1, wherein the card insertion port of the memory card attaching mechanism is provided on a lower face of an operation unit provided on a front face of the main body so that the memory card inserted into the memory card attaching mechanism is accommodated in the operation unit.

3. The heat cooking device according to claim 2, wherein a card cover for covering the card insertion port from beneath is rotatably provided.

4. The heat cooking device according to claim 3, wherein the operation unit is internally configured such that a flat face of the memory card inserted into the memory card attaching mechanism is in parallel to a mounting face of an electric circuit board provided in the operation unit.

5. The heat cooking device according to claim 4, further comprising a cooling fan configured to cool heating components provided in the machine chamber such that outside air is taken from the front grille panel into the machine chamber via an outside air intake port formed on the front face of the machine chamber, wherein the memory card attaching mechanism is disposed away from a path into which the cooling fan blows the outside air.

* * * * *